US007090029B2

(12) United States Patent
Cleary et al.

(10) Patent No.: US 7,090,029 B2
(45) Date of Patent: Aug. 15, 2006

(54) FIREFIGHTING BOMBLETS AND A PRECISION AERIAL FIREFIGHTING METHOD UTILIZING THE SAME

(75) Inventors: William W. Cleary, Pasadena, CA (US); Myles A. Rohrlick, San Diego, CA (US)

(73) Assignee: The Boeing Company, Chicago, IL (US)

( * ) Notice: Subject to any disclaimer, the term of this patent is extended or adjusted under 35 U.S.C. 154(b) by 34 days.

(21) Appl. No.: 10/883,523

(22) Filed: Jun. 30, 2004

(65) Prior Publication Data

US 2006/0011355 A1 Jan. 19, 2006

(51) Int. Cl.
*A62C 25/00* (2006.01)

(52) U.S. Cl. ..... 169/53; 169/36; 169/46; 169/47; 169/52; 169/58; 169/70; 244/136

(58) Field of Classification Search ..... 169/30, 169/36, 46, 47, 52, 53, 58, 70; 244/129.2, 244/136, 189, 190; 102/367, 369, 370, 382, 102/384

See application file for complete search history.

(56) References Cited

U.S. PATENT DOCUMENTS 1,903,348 A * 4/1933 Anderson ..... 169/36
2,306,321 A * 12/1942 Roberts ..... 244/136
2,349,980 A * 5/1944 Moore ..... 102/382
2,359,573 A * 10/1944 Mackay ..... 169/36
2,633,920 A * 4/1953 Carlson ..... 169/53
4,836,292 A * 6/1989 Behringer ..... 169/36
4,881,601 A * 11/1989 Smith ..... 169/53
5,794,889 A * 8/1998 Bailey ..... 244/136
5,878,819 A * 3/1999 Denoize et al. ..... 169/53
6,364,026 B1 * 4/2002 Doshay ..... 169/53
6,470,805 B1 * 10/2002 Woodall et al. ..... 102/370

* cited by examiner

*Primary Examiner*—Steven J. Ganey
(74) *Attorney, Agent, or Firm*—Ingrassia Fisher & Lorenz, P.C.

(57) ABSTRACT

A firefighting bomblet includes a container having rigid supportive walls that together define a faceted-sphere shape, a cavity disposed inside the container and defined by the walls, and an opening in one of the walls for filling the cavity with a fire retardant. The bomblet can further include a weak seam formed in one of the walls, the weak seam being adapted to be more easily ruptured than the remainder of the walls. A method for aerial firefighting includes the step of dropping at least one of the containers enclosing a fire retardant from an aircraft over a fire.

30 Claims, 4 Drawing Sheets

FIREFIGHTING BOMBLETS AND A PRECISION AERIAL FIREFIGHTING METHOD UTILIZING THE SAME

TECHNICAL FIELD

The present invention generally relates to aerial firefighting, and more particularly relates to methods and devices for dropping fire retardant from an aircraft during an aerial firefighting task. The invention also relates to a method for utilizing aircraft, fire retardants, and on-board computers to fight fires.

BACKGROUND

Conventional aerial firefighting includes the use of multi-engine airplanes or helicopters outfitted with an 800 to 7000 gallon tank containing approximately 6,700 to 58,000 pounds of water or other fire retardant. These airtankers, or waterbombers as they are known, are filled with fire retardant payloads and flown over wildfires where the fire retardant payloads are sprayed from the airtankers onto manually targeted locations below.

Airtankers typically fly at altitudes approximating about 150 feet during an aerial firefighting procedure. Such low firefighting altitudes are required in order to accurately and effectively deliver the fire retardant. Consequently, firefighting missions are flown through thick smoke, shifting winds and rugged terrain that includes tall trees and power lines. These dangers further hinder firefighting efforts by limiting aerial missions to only daylight hours with good visibility. Accordingly, there is a need for a system that enables a firefighting mission at night or in limited visibility to be routine rather than the exception.

Aerial firefighting effectiveness using conventional airtankers is further limited by the fact that the entire payload is released over a single location. If only a portion of the payload is needed at a particular target, or if there are multiple targets requiring immediate attention, a single aircraft cannot adapt by adjusting payload release.

Accordingly, it is desirable to provide firefighting methods and fire retardant delivery systems that make aerial firefighting safer and more effective. Furthermore, other desirable features and characteristics of the present invention will become apparent from the subsequent detailed description and the appended claims, taken in conjunction with the accompanying drawings and the foregoing technical field and background.

BRIEF SUMMARY

A firefighting bomblet is provided for use in aerial firefighting according to one embodiment of the invention. The firefighting bomblet comprises a container having rigid supportive walls that together define a faceted-sphere shape, a cavity disposed inside the container and defined by the walls, and an opening in one of the walls for filling the cavity with a fire retardant.

A firefighting bomblet is provided for use in aerial firefighting according to another embodiment of the invention. The firefighting bomblet comprises a container having rigid supportive walls, a cavity disposed inside the container and defined by the walls, a weak seam formed in one of the walls, the weak seam being adapted to be more easily ruptured than the remainder of the walls, and an opening in one of the walls for filling the cavity with a fire retardant.

A method is also provided for aerial firefighting. The method comprises the step of dropping at least one container enclosing a fire retardant from an aircraft over a fire.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

The present invention provides a firefighting system and firefighting components that are not limited to use with a certain type of aircraft, but are adaptable for any platform capable of flying above a predetermined location and dropping a small container. One main advantage of the present invention is the ability for large and small planes and other transports such as helicopters to be utilized as part of the precision aerial firefighting (PAFF) system. The PAFF system utilizes small firefighting components, or bomblets, that are easily and inexpensively manufactured. The bomblets are also easily stacked, transported, and quantified according to need. Additional cost savings are provided by the flexibility and adaptability inherent in the PAFF system. Further, although the PAFF system and the bomblets used therein are discussed in terms of firefighting, the system is useful to combat other environmental hazards such as oil and other chemical spills. Water or other fire retardant in the bomblets can be replaced with absorbent materials and/or chemicals to mitigate such environmental hazards. Further, the PAFF system may be used to prevent potential fires during times of draught.

Figure 1:
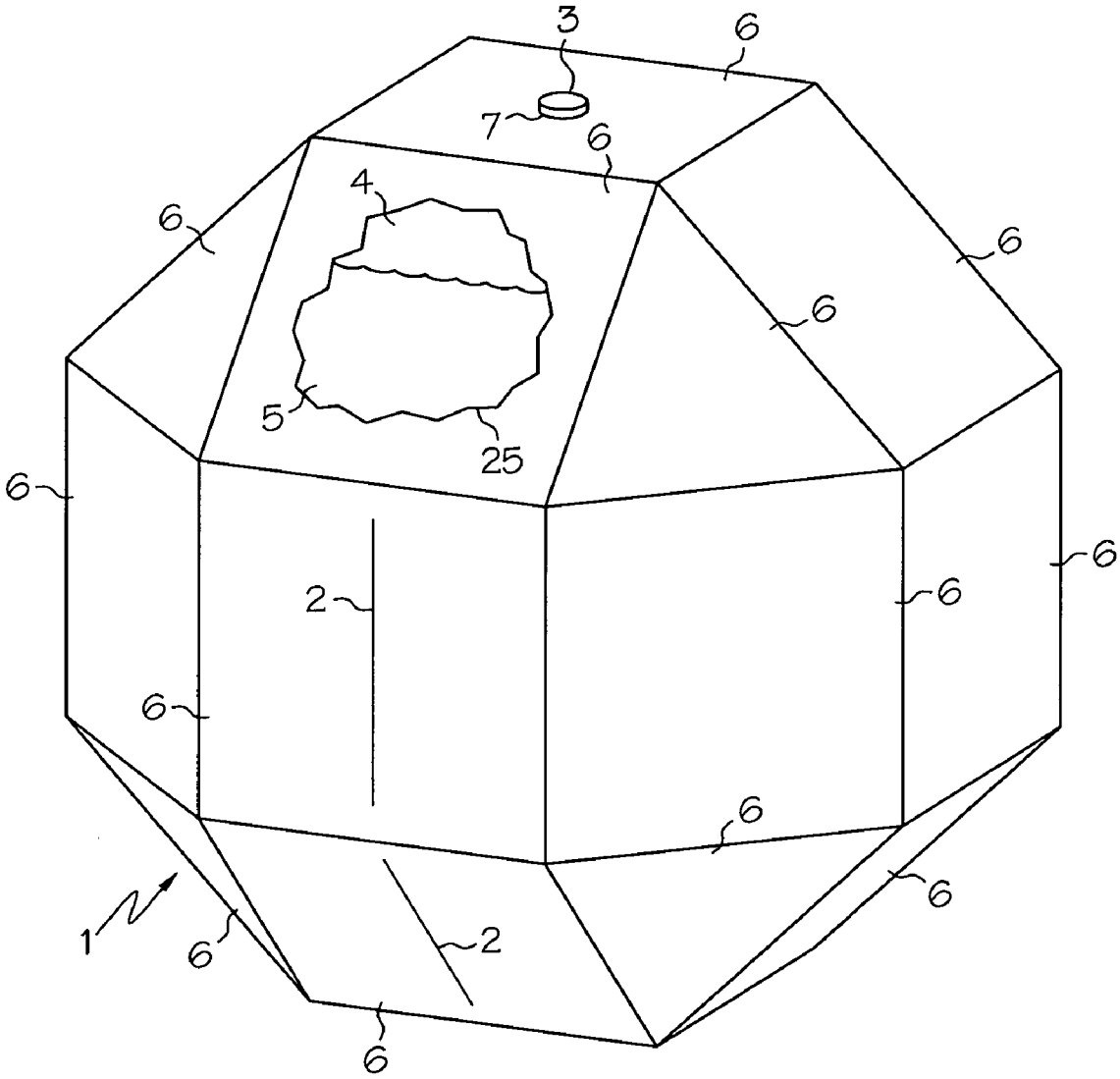
FIG. 1 is a perspective view of a firefighting bomblet having a faceted-sphere shape and a weak seam according to an embodiment of the present invention.

FIG. 1 is a perspective view of the firefighting container, or bomblet, according to the present invention. The bomblet 1 is designed to be dropped from an aircraft after being filled with fire retardant 5 as revealed from cutaway region 25. The bomblet 1 includes rigid supportive walls 6 and an opening 7 is formed through one of the walls, the opening providing a fluid passageway between the bomblet exterior and a cavity 4 defined by the walls 6. Once filled, the opening 7 is sealed with a plug or cap 3.

The bomblet walls 6 can be made using any material that gives the bomblet 1 sufficient durability to contain the fire retardant 5 and withstand the stresses associated with transferring the filled bomblet 1 onto an aircraft. The bomblet wall material should also be sufficiently durable to maintain the bomblet's structural integrity at least during the time when the bomblet 1 is dropped from the aircraft into high velocity wind. In an exemplary embodiment, the bomblet wall material is also biodegradable, for environmental reasons. One preferred material is an injection molded biodegradable polyethylene, which is an abundantly available, relatively inexpensive, and biodegradable material that provides sufficient rigidity and durability to meet the above-described needs.

The cavity 4 defined by the rigid bomblet walls 6 can have any given volume as long as the bomblet 1 can fit inside the aircraft cargo area, although optimal bomblet sizing takes into consideration such factors as bomblet handling ability and the necessary quantity of fire retardant for a particular firefighting plan. In an exemplary embodiment of the invention, the cavity 4 has a volume that allows for several bomblets to be loaded onto an aircraft and provide the total fire retardant payload. Employing a plurality of bomblets facilitates spreading of the fire retardant 5 over a larger targeted area than is possible with a conventional airtanker that releases the entire fire retardant payload at once. One preferred bomblet 1 has a cavity 4 of approximately 0.80 cubic feet to hold approximately 50 pounds of water or a fire retardant 5 having a similar density. The 50-pound size is ideal because it can be readily lifted and stacked by a human if necessary.

Figure 4:
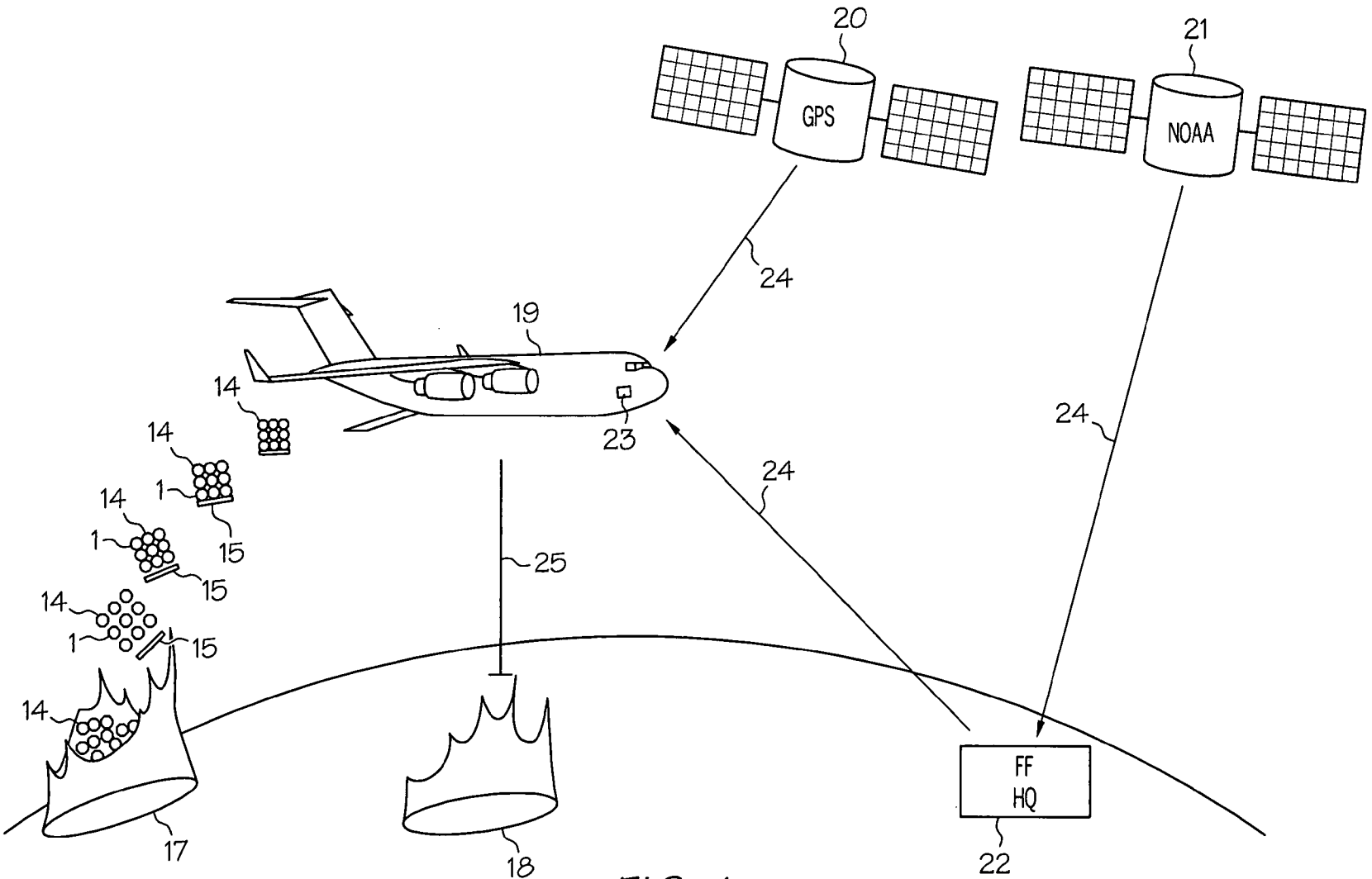
FIG. 4 is a diagram illustrating a firefighting system and method utilizing an aircraft, computer-aided targeting means, and containers to drop fire retardant on multiple targets.

The bomblet 1 is shaped to enable the cavity 4 to hold a maximal amount of fire retardant 5. A bomblet 1 that is approximately spherical in shape falls from the aircraft with minimal air resistance, enabling the bomblet 1 to fall true to target and effectively deliver the fire retardant 5 thereto. In the exemplary embodiment depicted in FIG. 1, the bomblet has a faceted-sphere shape. The faceted-sphere shape provides minimal air resistance to the bomblet 1, and further prevents rolling or other bomblet movement after the bomblet 1 is stacked and secured into the aircraft and before the bomblet 1 is released. Other advantages provided by the faceted-sphere shape include bomblet stackability, as depicted in FIG. 4. When empty, the bomblet 1 can be collapsed and stacked in a bowl-like fashion for efficient storage or shipment.

The fire retardant 5 can by any suitable formulation as long as it is containable within the bomblet cavity 4. Water and water-based fire retardants 5 are ideal for use with the bomblet 1 of the present invention.

The bomblet 1 includes a weak seam 2 that causes the bomblet 1 to rupture and release the fire retardant 5. Ideally, the weak seam 2 causes the bomblet 1 to rupture before it impacts with the ground. For instance, the bomblet 1 can be sufficiently weak due to the weak seam 2 to rupture upon impacting with trees or other above-ground objects. In another embodiment, the bomblet is sufficiently weak to rupture due to the force of wind velocity. By rupturing in the air, the bomblet 1 releases the fire retardant 5 atop the targeted fire and the fire retardant 5 spreads over a wide area. In yet another embodiment, the bomblet 1 is adapted to rupture when the bomblet 1 impacts with the ground.

The weak seam 2 can be incorporated into the bomblet walls 6 in a variety of ways depending on the bomblet's material and method of manufacture. In an exemplary embodiment the bomblet walls 6 are injection molded using a mold that produces a defined wall region that is integral with but thinner than the rest of the bomblet walls 6. The thin wall region is the weak seam 2, and ruptures when subjected to a predetermined force. In an exemplary embodiment of the invention, the weak seam 2 is formed to rupture when subjected to a predetermined amount of force created by wind as the bomblet 1 falls from the aircraft and nears the targeted fire.

Figure 2:
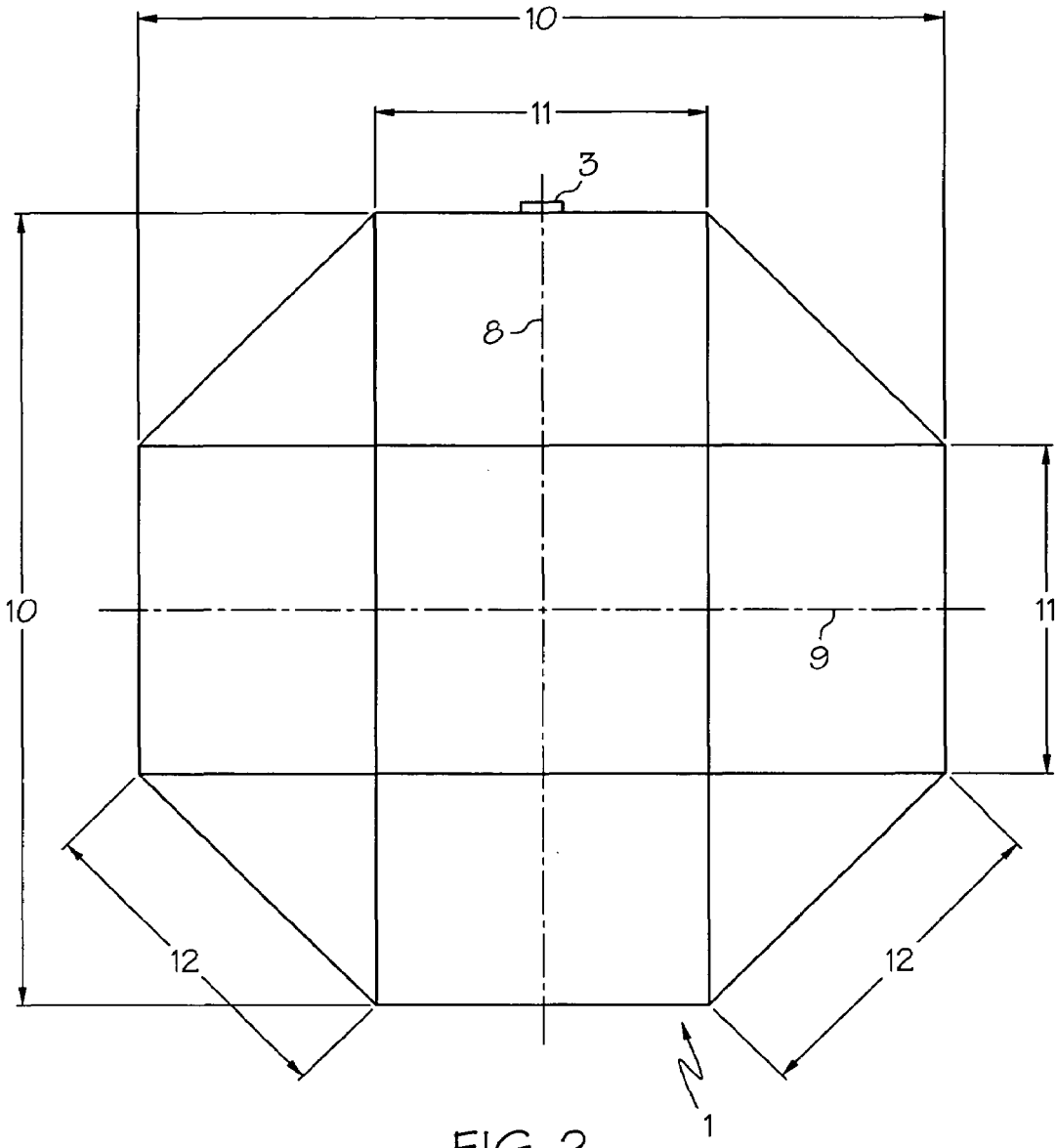
FIG. 2 is a front view of the container depicted in FIG. 1.

FIG. 2 is a view from any side of the bomblet 1 according to an exemplary embodiment of the invention, and illustrates the bomblet shape and symmetry. The bomblet outer surface is a pattern of adjacent identically sized squares and equilateral triangles creating an overall faceted-sphere shape.

As mentioned above, an exemplary bomblet 1 has a cavity 4 of approximately 0.80 cubic feet to hold approximately fifty pounds of water or a fire retardant 5 having a similar density. A bomblet having the faceted-sphere shape shown in FIG. 2 and sized to have a cavity of approximately 0.80 cubic feet has a width 10 of approximately 12.6 inches. The faceted-sphere consists of fourteen square faces and eight triangular faces, and is symmetric with respect to a vertical plane 8 and horizontal plane 9. Each facet intersecting the vertical and horizontal planes is a square with side lengths 11 equal to approximately 5.2 inches. To complete the faceted sphere, equilateral triangles with side lengths 12 equal to approximately 5.2 inches are positioned to connect groups of three squares.

Figure 3:
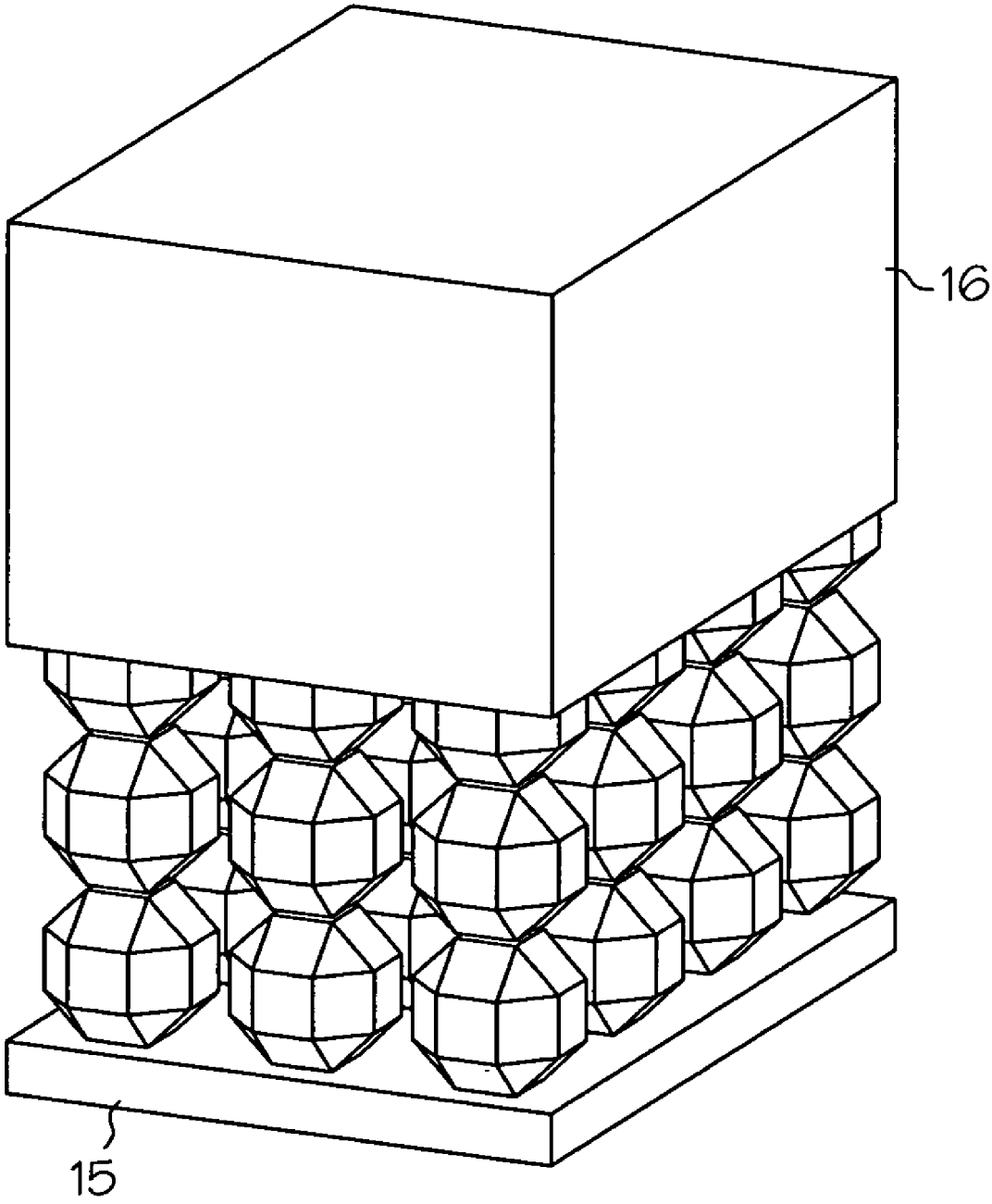
FIG. 3 is a perspective view of an airdrop configuration that utilizes a plurality of firefighting containers stacked on a pallet.

The bomblet faceted-sphere shape enables pluralities of bomblets 1 to be grouped and stacked to accommodate loading into an aircraft. FIG. 3 illustrates an airdrop configuration that includes a plurality of firefighting bomblets 1 stacked on a square pallet 15. The easily stacked bomblets 1 are ideally loaded in a stacked configuration onto the pallets 15 or another suitable support structure that eases bomblet transport onto an aircraft. The bomblets 1 can be further secured onto the pallets 15 by surrounding the bomblets 1 with shrink-wrap. FIG. 3 illustrates a box-type cover 16 that can be made of a material as simple as cardboard and used to secure the bomblets 1 onto a pallet 15.

The number of bomblets 1 in each stack and the overall size and shape of each bomblet stack can vary from aircraft to aircraft. The bomblet arrangement illustrated in FIG. 3 is designed to be stacked on a forty-eight by forty-eight inch pallet and loaded into a Boeing C-17 cargo plane. The bomblets 1 are fifty pound capacity water containers as described above, and are arranged three wide by four deep by three high, for a total of thirty-six bomblets.

FIG. 4 is a diagram illustrating a firefighting system that includes an aircraft 19, a computer-aided targeting system 23, and bomblets 1 to drop fire retardant on one or more targets 17. The aircraft 19 is selected from any aircraft that is capable of airdropping cargo. This is particularly advantageous since the aircraft 19 does not need expensive tank outfitting, and the maintenance associated with a spraying tank that conventional aerial firefighting aircraft incorporate. In one embodiment of the invention, the aircraft 19 is a Boeing C- 17 which has a large cargo capacity and proven airdrop performance. Thirty-six bomblets 1 are stacked on a standard forty-eight inch square pallet 15 to form an airdrop configuration 14. Seventy-eight of the configurations 14 are then loaded into the aircraft 19 for a total of approximately 2,800 bomblets 1 that together contain approximately 140,000 pounds of fire retardant 5, which is approximately five times the load capacity of a commonly used airtanker and one hundred times the load capacity of a helicopter. The increased capacity per aircraft allows for fewer aircraft to cover any given firefighting area.

Although the present invention can naturally be adapted for systems that require a pilot, navigator, or other person to manually target fires, an exemplary embodiment of the present includes a computer-aided targeting system 23. Data pertaining to the target location and weather conditions surrounding the target, and data pertaining to the aircraft including altitude, airspeed, and location are fed into the aircraft's onboard targeting computer 23. The onboard computer 23 uses the data to perform preprogrammed calculations that produce airdrop parameters including instructions for a pilot regarding when and where to release the fire retardant bomblets 1. Alternatively, the onboard computer can be programmed to automatically release the bomblets 1 when the aircraft 19 is positioned in a predetermined area with respect to the target location.

The data pertaining to the target and its surroundings is received by the onboard computer 23 via wireless transmission 24, or can be entered manually. The data comes from a variety of sources. For example, satellites 21 used by the National Oceanic and Atmospheric Administration (NOAA) provide infrared imaging and weather data. A firefighting headquarters station 22 receives the NOAA data and evaluates it in the context of the overall firefighting strategy to establish drop target locations and wirelessly transmits instructions for a pilot regarding when and where to release the fire retardant bomblets 1. Alternatively, the firefighting headquarters station 22 can wirelessly transmit the NOAA data to the onboard targeting computer 23 for some or all data processing. The aircraft location can also be determined by GPS satellites 20, although data pertaining to the aircraft elevation and airspeed are ideally determined using onboard sensors.

Computer-aided targeting enables aerial firefighting to be performed at high altitudes. Using the system of the present invention, an aircraft 19 can effectively target a fire at an elevation of between approximately 1,000 feet and approximately 2,000 feet above ground with great accuracy, even at night and other times of low visibility. Moreover, flying at high altitude allows the aircraft to fly well above the inclement weather, winds, and rugged terrain of targeted fire areas.

Another advantage to using a cargo aircraft 19 to drop bomblets 1 filled with fire retardant onto fires is that payloads can be partitioned to fight multiple targets on the same airdrop run. For example, after a primary target 17 has been bombed, the aircraft can immediately target a secondary fire target 18 utilizing bomblets that were not used on the primary target 17. Consequently, airdrop runs can be performed very efficiently, dropping only the needed amount of fire retardant 5 for each targeted location rather than expelling the entire payload.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

The invention claimed is:

1. A firefighting bomblet for use in aerial firefighting, comprising:

a container having rigid supportive walls that together define a faceted-sphere shape;

a cavity disposed inside the container and defined by the walls; and an opening in one of the walls for filling the cavity with a fire retardant.

2. The firefighting bomblet according to claim 1, wherein the walls form a pattern of adjacent identically sized squares and equilateral triangles to create the faceted-sphere shape.

3. The firefighting bomblet according to claim 2, wherein the faceted-sphere shape consists of fourteen square faces and eight triangular faces.

4. The firefighting bomblet of claim 1 wherein the cavity has a volume of approximately 0.80 cubic feet.

5. The firefighting bomblet according to claim 1, further comprising a seal for closing the opening.

6. The firefighting bomblet according to claim 1, further comprising a weak seam formed integral with the walls, the weak seam being adapted to be more easily ruptured than the walls.

7. The firefighting bomblet according to claim 6, wherein the bomblet is dropped from an aircraft during over a fire during aerial firefighting, and the weak seam is adapted to rupture when subjected to a force caused by wind velocity when the bomblet is dropped.

8. The firefighting bomblet according to claim 1 wherein the container is made of a biodegradable material.

9. The firefighting bomblet according to claim 8 wherein the biodegradable material is polyethylene.

10. A firefighting bomblet for use in aerial firefighting, comprising:

a container having rigid supportive walls;

a cavity disposed inside the container and defined by the walls;

a weak seam formed in and integral with one of the walls the weak seam being adapted to be more easily ruptured than the remainder of the walls; and an opening in one of the walls for filling the cavity with a tire retardant.

11. The firefighting bomblet according to claim 10, wherein the bomblet is dropped from an aircraft during over a fire during aerial firefighting, and the weak seam is adapted to rupture when subjected to a force caused by wind velocity when the bomblet is dropped.

12. The firefighting bomblet according to claim 10 wherein the walls, including the weak seam, are injected molded using the same continuous material.

13. The firefighting bomblet according to claim 12 wherein the weak seam is a wall region that is thinner than the rest of the walls.

14. The firefighting bomblet according to claim 10, further comprising a seal for closing the opening.

15. The firefighting bomblet according to claim 10 wherein said container is made of a biodegradable material.

16. The firefighting bomblet according to claim 15 wherein the biodegradable material is polyethylene.

17. The firefighting bomblet according to claim 10 wherein said cavity in said container has a volume of approximately 0.80 cubic feet.

18. A method of aerial firefighting, the method comprising the steps of:

dropping at least one container enclosing a fire retardant from an aircraft over a fire;

releasing the fire retardant from the container after the container is dropped from the aircraft and before the container impacts with the ground, wherein the step of releasing the fire retardant is performed as a result of a rupturing weak seam formed in the container.

19. The method according to claim 18, wherein the weak seam ruptures due to a force caused by wind velocity when the bomblet is dropped.

20. The method according to claim 19, wherein the container is formed to include continuous rigid supporting walls, and the weak seam is formed integral with the walls.

21. The method according to claim 20 wherein the walls, including the weak seam, are injected molded using the same continuous material.

22. The method according to claim 21 wherein the weak seam is a wall region that is thinner than the rest of the walls.

23. The method according to claim 18, wherein the containers are stacked inside the aircraft when they are dropped therefrom, each of the containers comprising rigid supportive walls that together define a faceted-sphere shape, wherein a plurality of the containers are substantially simultaneously dropped from the aircraft over the fire.

24. The method according to claim 23 wherein the walls form a pattern of adjacent identically sized squares and equilateral triangles to create the faceted-sphere shape.

25. The method according to claim 24 wherein the faceted-sphere shape consists of fourteen square faces and eight triangular faces.

26. The method according to claim 18 wherein the container has a volume of approximately 0.80 cubic feet.

27. The method according to claim 18 further comprising the step of:

targeting the fire using an on-board computer before dropping the container.

28. The method according to claim 27 wherein the step of targeting the fire comprises inputting data into the computer pertaining to the target location and weather conditions surrounding the target, and processing the data using the computer to produce parameters for dropping the container.

29. The method according to claim 28 wherein the step of targeting the fire further comprises inputting data into the computer pertaining to the aircraft altitude, airspeed, and location.

30. The method according to claim 27 wherein the step of dropping the container is automatically controlled using the computer.

* * * * *